US007316565B2

(12) United States Patent
Liao

(10) Patent No.: US 7,316,565 B2
(45) Date of Patent: Jan. 8, 2008

(54) ACTION RECIPROCATING STRUCTURE OF A TOY GUN

(75) Inventor: Yin-Hsi Liao, Sijhih (TW)

(73) Assignee: Guay Guay Trading Co., Ltd., Taipei County (TW)

( * ) Notice: Subject to any disclaimer, the term of this patent is extended or adjusted under 35 U.S.C. 154(b) by 0 days.

(21) Appl. No.: 11/488,698

(22) Filed: Jul. 19, 2006

(65) Prior Publication Data

US 2007/0204841 A1 Sep. 6, 2007

(30) Foreign Application Priority Data

Mar. 2, 2006 (JP) ..... 2006-001459 U

(51) Int. Cl.
*F41A 33/06* (2006.01)

(52) U.S. Cl. ..... 434/18; 124/65

(58) Field of Classification Search ..... 434/18; 124/65, 70–77

See application file for complete search history.

(56) References Cited

U.S. PATENT DOCUMENTS 2,708,319 A * 5/1955 Tratsch ..... 434/18
4,480,999 A * 11/1984 Witherell et al. ..... 434/18
5,351,598 A * 10/1994 Schuetz ..... 89/185
5,857,854 A * 1/1999 Kwalwasser ..... 434/18
6,682,350 B2 * 1/2004 Kehl et al. ..... 434/18
6,901,689 B1 * 6/2005 Bergstrom ..... 42/1.06
6,938,534 B2 * 9/2005 Fleming et al. ..... 89/190
7,197,973 B2 * 4/2007 Fleming et al. ..... 89/190
2005/0074726 A1 * 4/2005 Metcalfe et al. ..... 434/18
2006/0027225 A1 * 2/2006 Homsky ..... 124/72

* cited by examiner

*Primary Examiner*—Troy Chambers
(74) *Attorney, Agent, or Firm*—Troxell Law Office, PLLC

(57) ABSTRACT

An action reciprocating structure of a toy gun an action part and a gear box of a loading mechanism, of a toy gun, wherein the action part is located at a top of the toy gun, the gear box is located at a bottom of the toy gun, and a reciprocating mechanism is located between the action part and the gear box. The reciprocating mechanism includes a pump mechanism, connected to a reciprocator which is provided with an elastic member and a small piston having an air-tight ring therein. When the pump mechanism is filled with gas to push an air-tight piston in the pump mechanism, it also pushes the elastic member and the small piston of the reciprocator, such that the action part which is connected on the small piston can achieve an emulated shooting effect of a reciprocate movement, at the same time.

2 Claims, 7 Drawing Sheets

ACTION RECIPROCATING STRUCTURE OF A TOY GUN

BACKGROUND OF THE INVENTION (a) Field of the Invention

The present invention relates to an action reciprocating structure of a toy gun, and more particularly to an action reciprocating structure of a toy gun, which is provided with a reciprocating mechanism including a pump mechanism, and a reciprocator connected to the pump mechanism.

(b) Description of the Prior Art

Referring to FIG. 1 and FIG. 2, it shows an action A1 of a conventional toy gun A, wherein a resetting pump B is located between an upper barrel A2 and a gear box A3 of the toy gun A, and an interior of the resetting pump B is provided with an elastic member B1. When the action A1 of toy gun A is pushed back to be fixed, the resetting pump B will be filled with gas to push a bullet which is loaded at a front of the resetting pump B, thereby accomplishing one shooting operation. However, as the resetting pump B between the upper barrel A2 and gear box A3 of the ordinary toy gun A should push back the action A1 of toy gun A to be fixed one more time in shooting; therefore, a shooting effect which is similar to a real gun will not be achieved by the action A1 of toy gun A.

Accordingly, how to eliminate the aforementioned drawback is a technical issue to be resolved by the inventor of present invention.

SUMMARY OF THE INVENTION

The present invention is to provide an action reciprocating structure of a toy, which is provided with a reciprocating mechanism including a pump mechanism, and a reciprocator connected to the pump mechanism; therefore, when the pump mechanism is filled with gas to push an air-tight piston in the pump mechanism, it also pushes an elastic member and a small piston in the reciprocator, such that an action part which is connected to the small piston can achieve an emulated shooting effect of a reciprocated movement at the same time.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
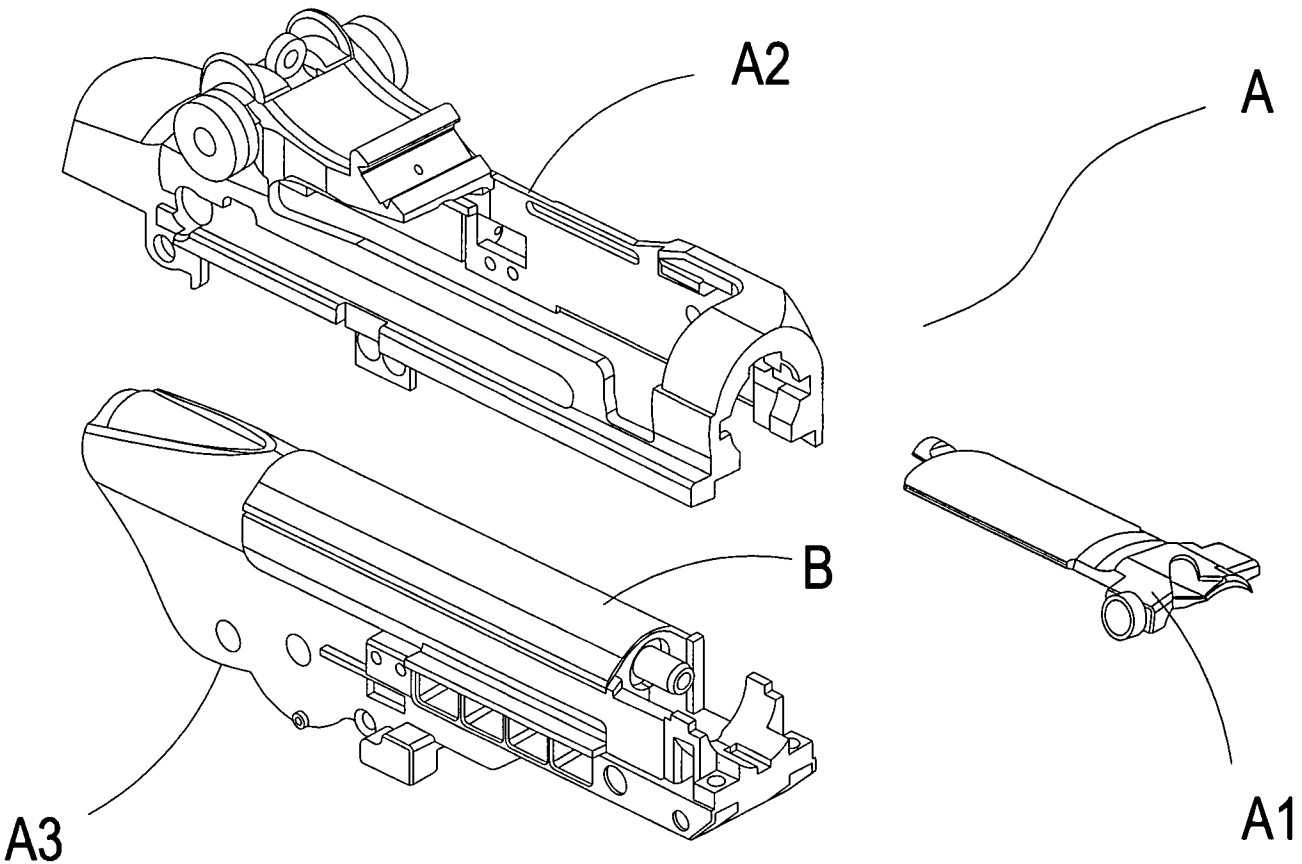
FIG.1 Prior Art
FIG. 1 shows an exploded view of a conventional toy gun.
Figure 2:
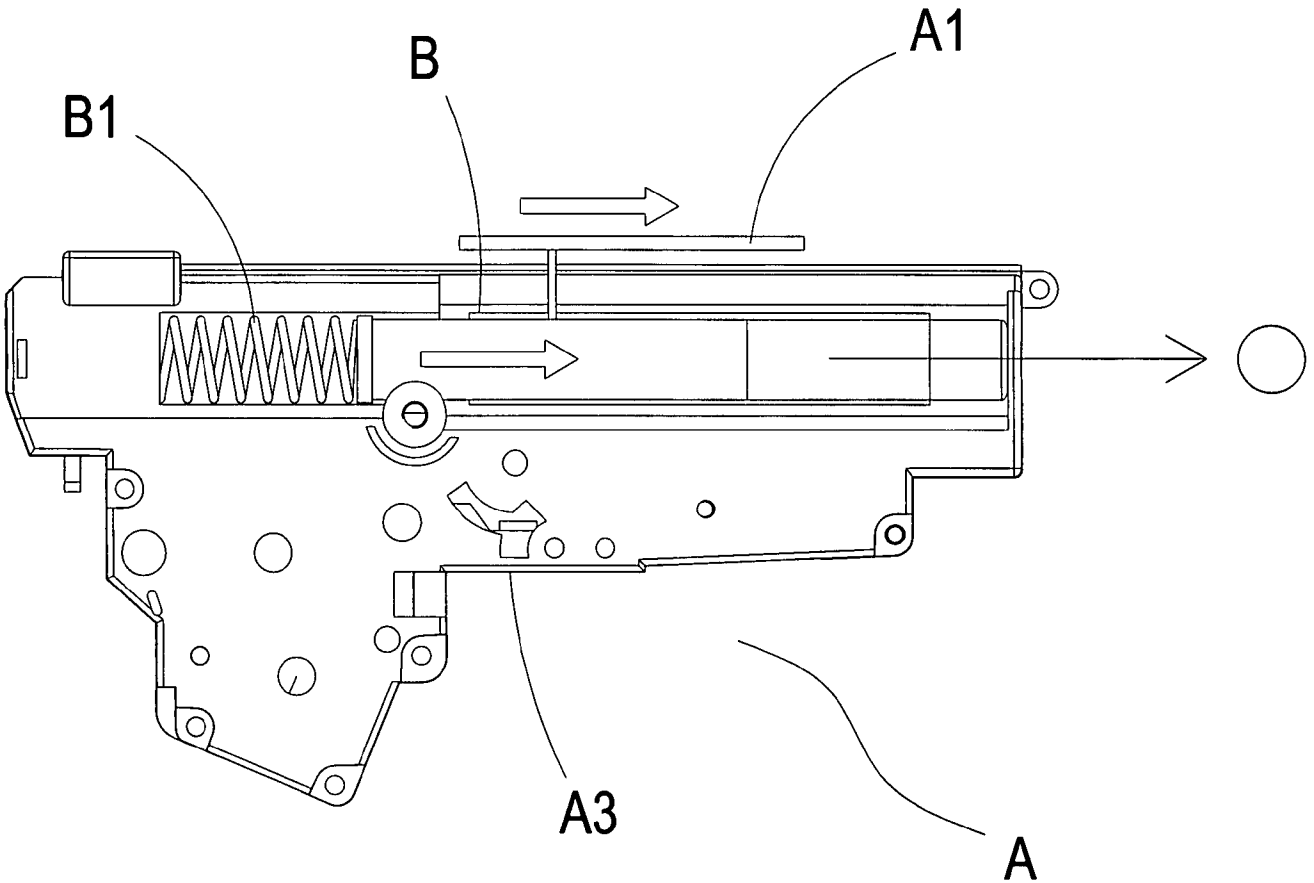
FIG.2 Prior Art
FIG. 2 shows a schematic view of a motion of a conventional toy gun.
Figure 3:
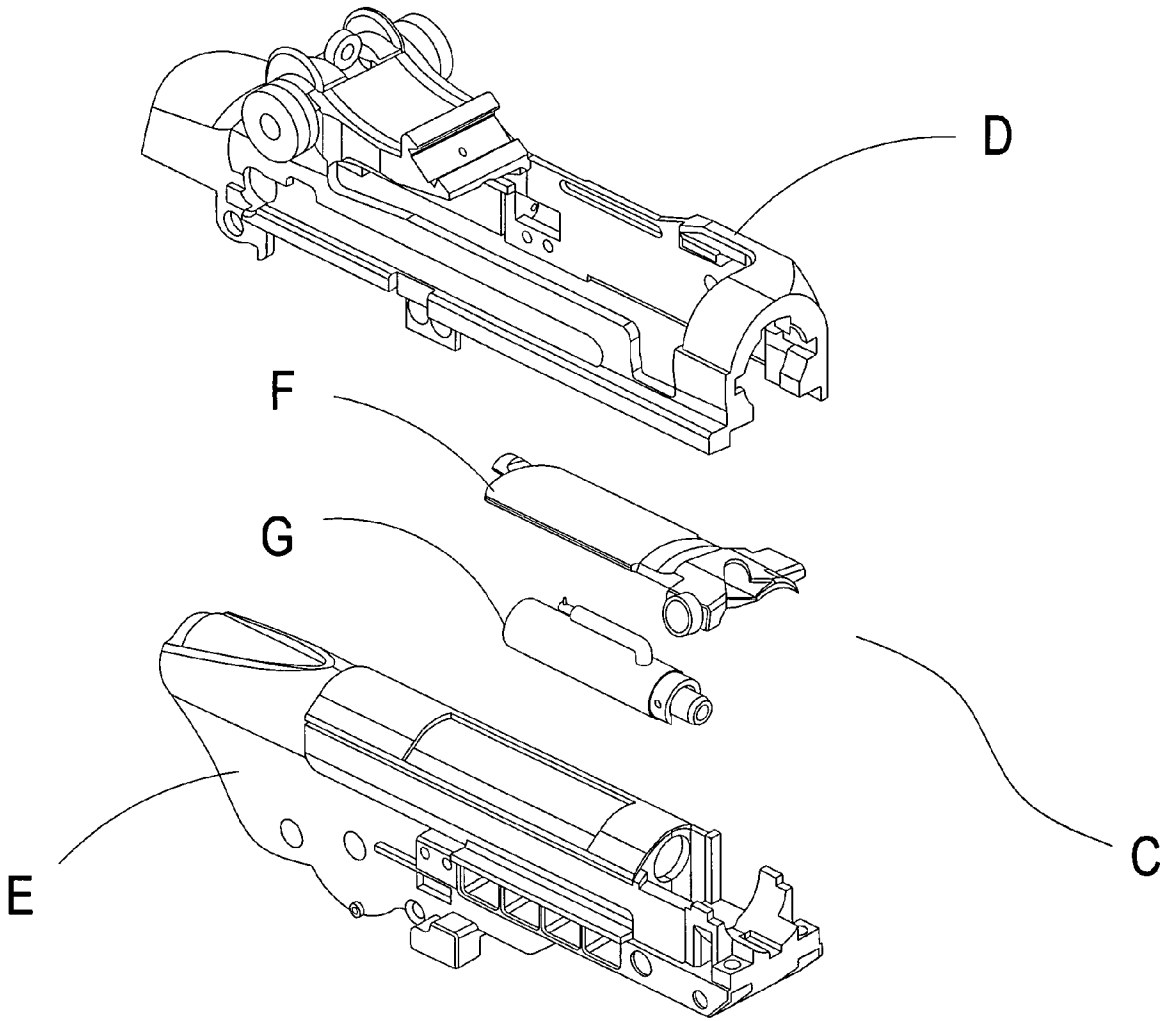
FIG. 3 shows an exploded view of the present invention.
Figure 4:
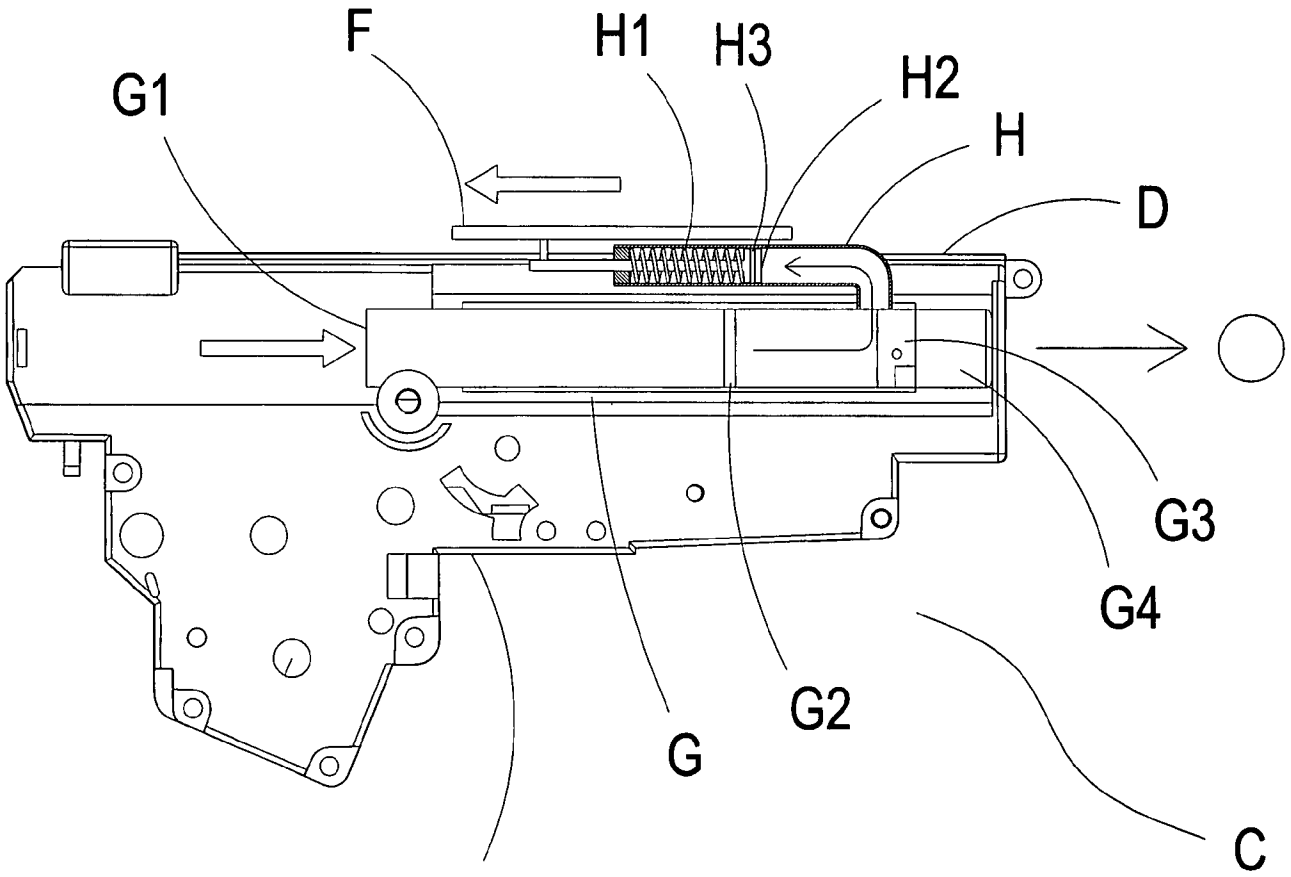
FIG. 4 shows a schematic view of a motion of the present invention.

Referring to FIG. 3 and FIG. 4, the present invention is to provide an action reciprocating structure of a toy gun, which comprises primarily an upper barrel D, a gear box E, an action part F, and a reciprocating mechanism G of a toy gun C.

The upper barrel D is provided with the action part F of toy gun C, and the gear box E of a loading mechanism. The action part F is located at a top of the toy gun C, and the gear box E is located at a bottom of the toy gun C, whereas the reciprocating mechanism G is located between the action part F and the gear box E.

The reciprocating mechanism G includes a pump mechanism G1, and a reciprocator H which is connected to the pump mechanism G1. The pump mechanism G1 is provided with an air-tight piston G2, and a piston head G3 which is connected to the air-tight piston G2. Moreover, the piston head G3 is provided with a firing chamber G4.

The reciprocator H is provided with an elastic member H1, and a small piston H2 which is connected to the action part F. The small piston H2 is provided with an air-tight ring H3, and an end of the small piston H2 is connected to the action part F to be fitted with the pump mechanism G1 of the reciprocating mechanism G, correspondingly.

Accordingly, when the pump mechanism G1 is filled with gas to push the air-tight piston G2 of the pump mechanism G1, it can also push the elastic member H1 of the reciprocator H, and the small piston H2 which is provided with the air-tight ring H3, such that the action part F, which is connected on the small piston H2, can achieve an emulated shooting effect of reciprocated movement at the same time, in a shooting status.

Figure 5:
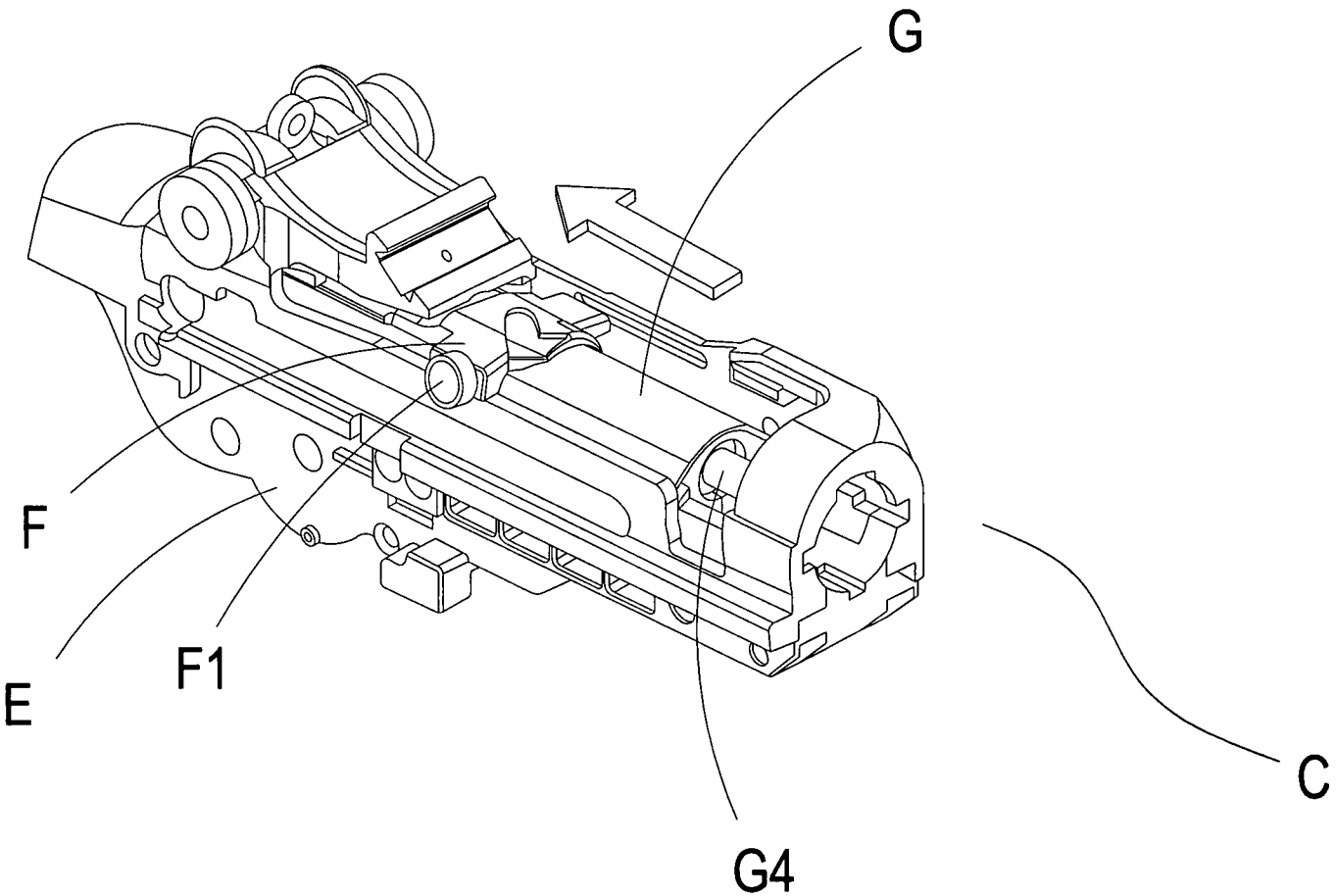
FIG. 5 shows a schematic view of an embodiment of the present invention.
Figure 6:
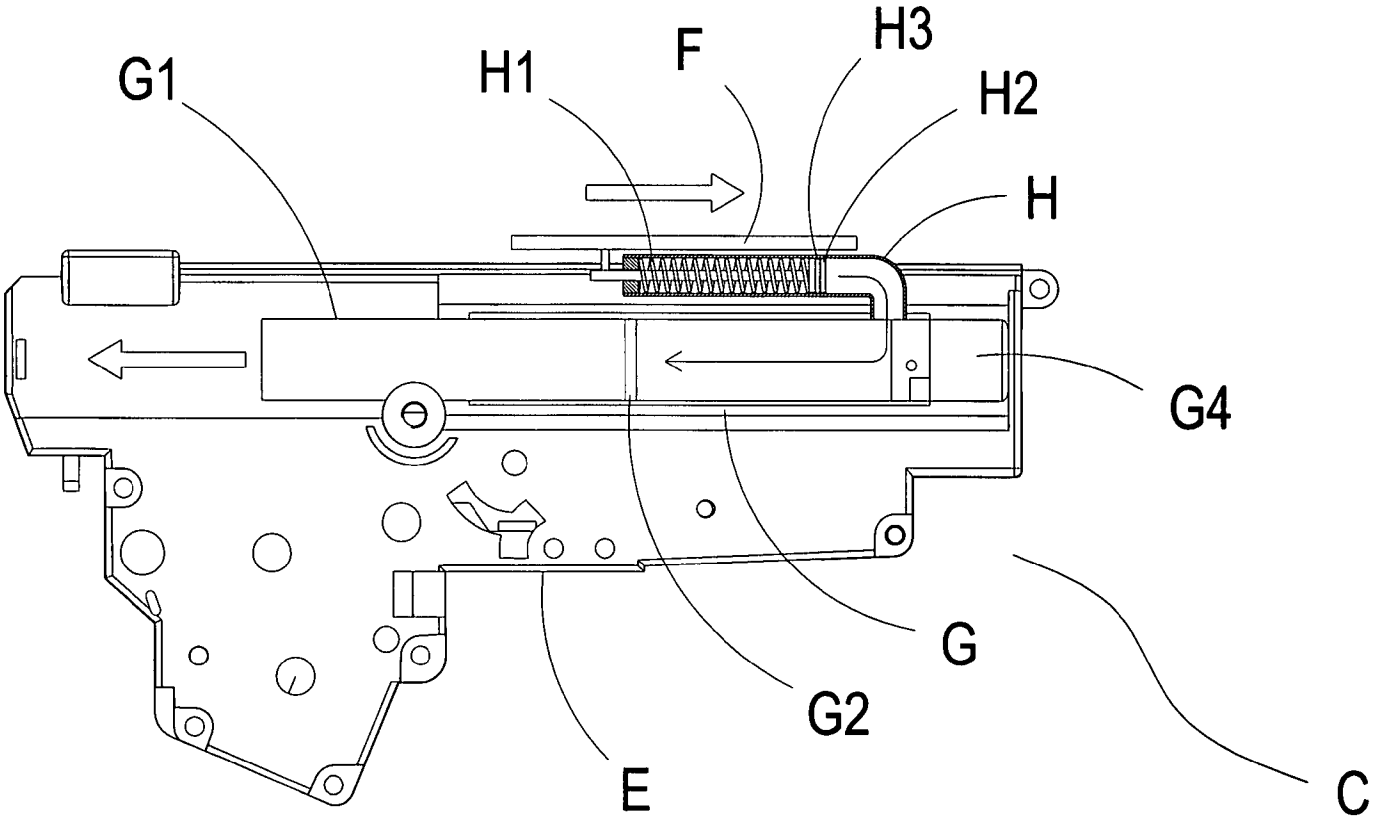
FIG. 6 shows a cutaway view of the present invention.
Figure 7:
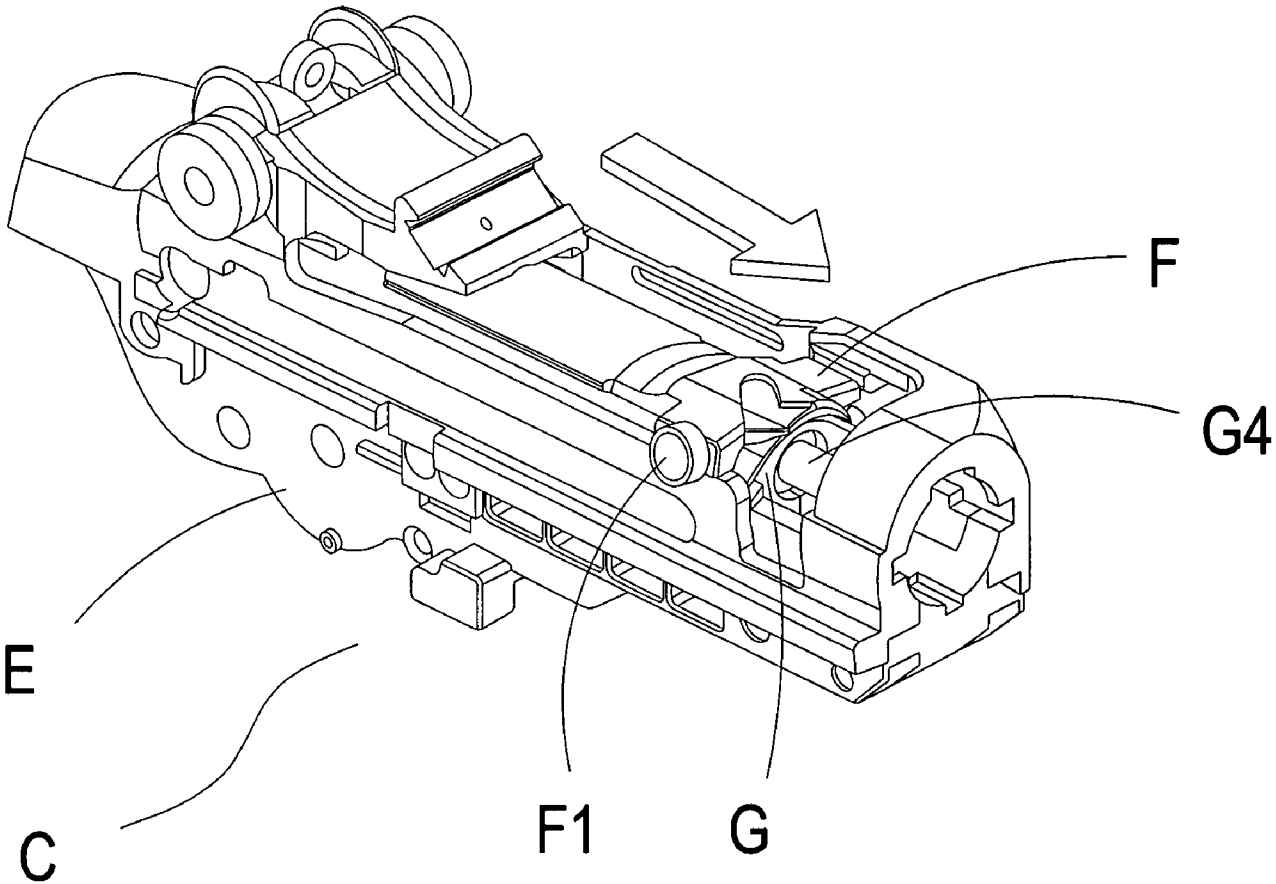
FIG. 7 shows another schematic view of an embodiment of the present invention.

Referring to FIGS. 5 to 7, the top of toy gun C is provided with the action part F, and the bottom of toy gun C is provided with the gear box E, whereas the reciprocating mechanism G is located between the action part F and the gear box E. When the gas in an interior of the pump mechanism G1 pushes the air-tight piston G2 of the pump mechanism G1, it can also push the elastic member H1 of the reciprocating mechanism H, and the small piston H2 which is provided with the air-tight ring H3, such that the action part F, which is connected to the small piston H2, can result in a shooting operation of reciprocated movement, at the same time.

Through the gas which is filled in the pump mechanism G1, the pump mechanism G1 of the reciprocating mechanism F, and the reciprocating mechanism F which is connected to the pump mechanism G1, can shoot out a bullet which is loaded in the firing chamber G4. In the same time, through the gas in an interior of the pump mechanism G1, the air-tight piston G2 of the pump mechanism G1 can also push the small piston H2 of the reciprocator H, enabling the action part F connected to the small piston H2 to drive a pull lever F1 which is connected to the action part F, thereby achieving the emulated shooting effect as a real gun, during the shooting process of the toy gun C.

After the gas in the pump mechanism G1 pushes the air-tight piston G2 of the pump mechanism G1, through a counterforce of compressing the gas in the pump mechanism G1, the small piston H2 and elastic member H1 of the reciprocator H will drive the action part F which is connected to the small piston H2, and the pull lever F1 to restore to their original positions before firing.

The reciprocating mechanism G and the reciprocator H can be further implemented to a pistol, a rifle, a gas gun, an electric air gun, a paintball gun, and other related fire arm which can result in an emulated shooting operation as a real gun by a pushing of gas, to provide the emulated shooting effect of reciprocated movement.

To further manifest the advancement and practicability of the present invention, the present invention is compared with a conventional toy gun as below:

Shortcomings of a conventional toy gun:

1. The operation of toy gun cannot achieve a shooting effect like a real gun.
2. The resetting pump of toy gun can only perform one operation of positioned shooting.
3. The resetting pump and the action cannot provide a reciprocated movement during shooting.

Advantages of the present invention:

1. The reciprocating mechanism between the action part and the gear box can provide a reciprocated movement.
2. The action part can move in reciprocation by the gas pressure inside the pump mechanism.
3. Shooting a bullet and moving the action part can occur at the same time, thereby simplifying an operational procedure of the toy gun.
4. The action part can be restored to its original position through a reverse pushing of the gas.
5. It is provided with the advancement and practicability.
6. It is provided with an industrial competitiveness.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. An action reciprocating structure of a toy gun comprising an action part and a gear box of a loading mechanism, of a toy gun, wherein the action part is located at a top of the toy gun, the gear box is located at a bottom of the toy gun, and a reciprocating mechanism is located between the action part and the gear box; the reciprocating mechanism including a pump mechanism, and a reciprocator which is connected to the pump mechanism; the reciprocator being provided with an elastic member and a small piston which is provided with an air-tight ring; when the pump mechanism being filled with gas to push an air-tight piston in the pump mechanism, the pump mechanism simultaneously pushing the elastic member and the small piston in the reciprocator, such that the action part connected on the small piston enables an emulated shooting effect of a reciprocated movement.

2. The action reciprocating structure of a toy gun according to claim 1, wherein the reciprocating mechanism and the reciprocator is further implemented to a pistol, a rifle, a gas gun, an electric air gun, a paintball gun, and other related fire arm which result in an emulated shooting operation as a real gun by a pushing of gas, to provide the emulated shooting effect of reciprocated movement.

* * * * *